United States Patent [19]

Cioffi et al.

[11] Patent Number: 4,655,395

[45] Date of Patent: Apr. 7, 1987

[54] ADJUSTABLE CONICAL ATOMIZER

[75] Inventors: Paul L. Cioffi, Massillon; Thomas S. Donahoe, Alliance; George R. Keith, Uniontown, all of Ohio

[73] Assignee: The Babcock & Wilcox Company, New Orleans, La.

[21] Appl. No.: 600,623

[22] Filed: Apr. 17, 1984

[51] Int. Cl.[4] ..... B05B 7/00

[52] U.S. Cl. ..... 239/427; 239/432; 239/433; 239/456; 239/518

[58] Field of Search ..... 239/432–434, 239/456, 457, 512–514, 518, 419, 424.5, 429, 434.5, 524, 427, 423

[56] References Cited

U.S. PATENT DOCUMENTS

| | | | |
|---|---|---|---|
| 1,003,700 | 9/1911 | Busch | 239/434 |
| 1,561,848 | 11/1925 | Green | 239/419 |
| 2,192,996 | 3/1940 | Fenzl | 239/433 |
| 2,973,150 | 2/1961 | Golec | 239/433 |
| 3,224,679 | 12/1965 | Kear et al. | 239/424.5 X |
| 3,346,412 | 10/1967 | Siegenthaler et al. | 239/424.5 X |
| 3,603,512 | 9/1971 | Ham | 239/524 X |
| 3,680,781 | 8/1972 | Lincoln | 239/434.5 X |
| 4,002,297 | 1/1977 | Pillard | 239/433 |

*Primary Examiner*—Andres Kashnikow

*Attorney, Agent, or Firm*—Robert J. Edwards; K. W. Iles

[57] ABSTRACT

An adjustable conical atomizer comprises a body part having an end or discharge face with a conical recess and a conical plug having a complementarily conically-formed surface which is adjustably positioned in the conical recess. The size of the cavity formed between the plug and the body is varied by changing the relative positions of the plug and the body, for example, by using an indexing bolt which connects the body part and the plug parts. The body or a connection to the body is provided with channels or passages for the passage of two or more fluid streams into the space between the plug and the body part for intimate mixing therein. The fluid stream includes a liquid which is accelerated in this zone between the body and the plug. The plug and the body form an annular discharge therebetween which diverges in an outward direction.

3 Claims, 4 Drawing Figures

ADJUSTABLE CONICAL ATOMIZER

BACKGROUND OF THE INVENTION

1. Field of the Invention

This invention relates, in general, to combustion devices and, in particular, to a new and useful adjustable conical nozzle for the fuel constituents in which a compressed fluid, such as steam or air is used to accelerate an incompressible fluid or liquid such as oil or water. More particularly, the present invention is directed to a dual fluid atomizer in which the compressible fluid, such as steam or air, accelerates an incompressible fluid or liquid, such as oil or water, to a high speed.

In dual fluid atomizers, acceleration of a liquid stream is usually accomplished by mixing a high speed compressible fluid stream with a slower speed liquid stream. This process subjects the liquid to a strong shearing force that breaks it into small droplets. Most known atomizers are either: (1) external mixing atomizers, in which two fluid streams are mixed primarily outside of the structure of the atomizer; or (2) internal mixing atomizers in which the two fluid streams mix primarily inside the main structure of the atomizer.

A disadvantage of some of the known atomizers is that the atomized mixture is directed from one or more mixing holes in the form of concentrated jets. The jets are highly localized and provide less-than-optimum dispersion of the atomized mixture. Consumption of compressible fluid by an atomizer is largely determined by the geometry of the atomizer, including the hole sizes and arrangements, and these characteristics can importantly influence the atomization fineness, turn-down ratio and cost of operation.

In one type of internal mixing atomizer, the two fluid streams are introduced through separate holes at a point inside the atomizer and those holes intersect at an angle and merge into a third hole. The mixing and acceleration process takes place primarily in the third hole and the dual fluid mixture is released from the mixing hole at high speed into the surroundings, so that further shearing may take place between the liquid and the surroundings. Such conventional multi-hole atomizers produce a spray pattern comprising distinct jets separated by voids. When the flow of liquid fuel is reduced or turned down, the jets become thinner and the voids become larger. When such a fuel atomizer is used in combination with an optical flame detector, the thinning of the jets in the spray pattern can cause an erroneous loss of ignition indication from the flame detector.

SUMMARY OF THE INVENTION

In accordance with the present invention, an adjustable conical atomizer is provided which includes a body part which has an end face with a recess shaped correspondingly to a plug part and the plug part is adjustably positioned in the recess and defines an outwardly diverging space forming a discharge for fuel components which are separately led to the space between the plug and the body part. The plug is advantageously made and fits into a mating conical recess of the body part. The size of the conical cavity formed between the plug and the body part is varied by changing the relative positions of the plug in the body back and forth along the axis of the plug. An indexing bolt is advantageously used to position the plug and the body relative to each other to form the conically diverging flow space that defines an annular discharge opening at the end face of the body. Component fuel fluid streams enter the atomizer through holes in the body or suitable other passages. The fluid streams mix in the space between the plug and the body. Alternatively, they may be partially mixed upstream of the plug and the body and then flow into the space between the plug and body for further mixing and acceleration. In either arrangement, acceleration is advantageously provided primarily in the conical zone or cavity, referred to hereafter as a conical annulus between the atomizer body and the plug.

In accordance with the invention, the position of the body relative to the plug determines the amount of compressible fluid used to atomize a given quantity of liquid under a given set of operating conditions. The relative position of the plug should also affect the resultant droplet size distribution produced by the atomizer.

With the inventive arrangement, the position of the plug relative to the body controls the flow of compressible fluid, unlike most of the internal mixing atomizers, which act primarily as deflectors. The two-fluid mixture exits the atomizer of the invention around the entire circumference of the plug, providing better dispersion of the droplets generated.

An advantage of the invention includes the adjustable geometry feature of the plug relative to the body, which is particularly desirable for some applications. The plug may, however, be fixed relative to the body if desired. The continuous spray pattern produced by the conical atomizer is readily sensed by the optical flame detector. This results in fewer erroneous failed flame indications from the flame detector and fewer operational problems at low fuel loads. Therefore, the conical atomizer can be operated and successfully monitored over a wider load range than is currently possible with conventional atomizers. The adjustable geometry of the conical atomizer provides improved control of the compressible fluid flow. This improved control can result in lower operating costs and in improved turn-down.

Accordingly, it is an object of the invention to provide an improved adjustable conical atomizer which includes a body portion having an end or discharge face with a cavity and including a plug member having a surface complementary to the cavity surface which is positioned in the cavity at a selected spacing therefrom so as to define a liquid and gas mixing area therebetween and including means defining separate passages for the liquid and gaseous component which are directed into the mixing space between the plug and the body wherein the mixture is discharged in the annular opening between the plug and the body.

A further object of the invention is to provide a fuel atomizer in which a liquid and a gaseous component are premixed and directed to an annular space between a plug and body member where the components are further mixed and accelerated before being discharged in an annular spray.

A further object of the invention is to provide an atomizer which is simple in design, rugged in construction and reliable in operation.

For an understanding of the principles of the invention, reference is made to the following description of typical embodiments thereof as illustrated in the accompanying drawings.

GENERAL DESCRIPTION OF THE PREFERRED EMBODIMENTS

Figure 1:
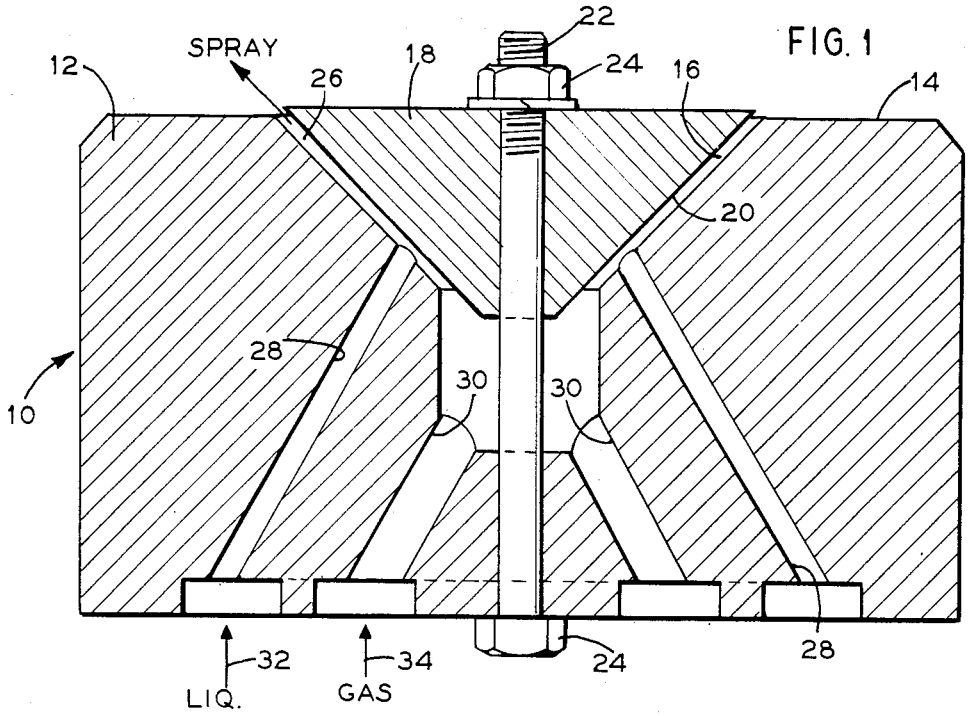
FIG. 1 is a sectional view of an atomizer constructed in accordance with the invention.

Referring to FIG. 1, the invention comprises atomizer 10 which, in the embodiment disclosed, comprises a body part 12 having end face 14 with conical cavity 16. Body part 12 cooperates with plug 18 having conical face 20 complementary to conical recess 14 of body part 12. Conical face 20 is positioned in cavity 16 at a selected spacing therefrom.

The position of plug 18 within body part 12 may be adjusted by means of indexing bolt 22, which is secured by nuts 24 to body part 12 and plug 18.

Mixing space 26 is formed between plug 18 and body part 12. Its size may be varied by changing the relative positions of plug 18 and the body part 12 by means of indexing bolt 22. While indexing bolt 22 is advantageously used to position plug 18 relative to the body part 12, other arrangements may be provided for the same function.

In operation, separate fluid streams of a liquid and a gas enter through separate liquid conduits 28 and gas conduit 30, in body part 12, as indicated by arrows 32 and 34 in FIG. 1. Liquid conduit 28 and gas conduit 30 are shown indicated as long holes, but they may be of any desirable shape, number or arrangement, so long as they discharge into the mixing space 26, where acceleration of the liquid advantageously takes place. It has been found that an embodiment having equally spaced conduits is the best arrangement for a given number of conduits. The liquid capacity will determine the number and the size of the conduits required. In a preferred embodiment six such equally spaced conduits are used. Mixing space 26 has an annular discharge opening around the entire circumference of plug 18.

Figure 2:
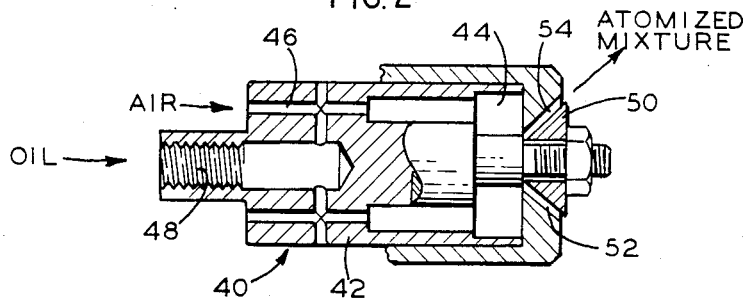
FIG. 2 is a view similar to FIG. 1 of another embodiment of the invention.

In the embodiment shown in FIG. 2, atomizer 40 includes body 42 having interior space 44 in which air and fuel, which enter from space gas inlet 46 and liquid inlet 48, are initially mixed. Atomizer 40 also includes plug 50 which is adjustably positioned relative to conical recess 52 of body 42. Mixing space 54 is formed between plug 50 and body 42 and acceleration of the liquid takes place primarily in this location.

Figure 3:
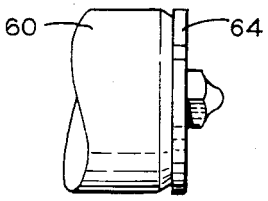
FIG. 3 is a partial side elevational view of another embodiment of the invention.
Figure 4:
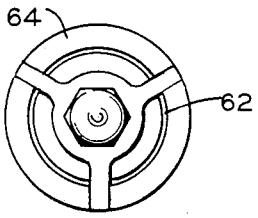
FIG. 4 is an end view of the embodiment shown in FIG. 3.

As shown in FIGS. 3 and 4, atomizer 60 includes mixing space 62 for the fuel component similar to the other embodiments but it has, in addition, an end insert or deflector 64 which produces regular breaks in the conical spray pattern and provides better dispersion.

As shown in FIG. 4, the insert or deflector 64 comprises a separate break ring having radially extending portions disposed over the annular discharge for breaking up the mixture exiting from the discharge.

It should be appreciated that plug 18 which forms mixing cavity 26 with body 12 in each of the embodiments may be shaped other than conically in accordance with the manufacturing considerations and operational considerations. In some instances, it may be desirable to change the flow paths of the individual fluid components. For example, the gas may be directed through liquid conduit 28 in FIG. 1 and the liquid through gas conduit 30. Also, in some instances it may be desirable to bring the liquid conduits 28 into a common manifold upstream of the mixing cavity 26. In addition to liquids, the adjustable conical atomizer may be used to atomize slurries or other mixtures. Atomizers according to the present invention are useful for liquid fuels, for spray drying of various substances and for dry scrubbing of flue gas.

While specific embodiments of the invention have been shown and described in detail to illustrate the application of the principles of the invention, it will be understood that the invention may be embodied otherwise without departing from such principles.

What is claimed is:

1. An adjustable conical atomizer for fluids comprising a body having an end face with a conical cavity therein, a plug having a conical side matching the configuration of the conical cavity and positioned with the conical side in the conical cavity, a manually adjustable indexing bolt connected between said plug and said body, means for positioning said plug in respect to said cavity so as to define a mixing space therebetween in the form of a continuous conical annulus and an annular discharge opening from the mixing space in the end face, at least two passages extending through the body for directing a liquid and a gas into the mixing space to produce the mixing together and acceleration of the liquid and gas in the mixing space and the discharge of the mixture as a conical spray through the annular discharge opening, and wherein one of the passages discharges into the mixing space at a location intermediate the inlet and outlet of the cavity and the other one of the passages discharges into the inlet of said cavity.

2. An adjustable conical atomizer for fluids comprising a body having an end face with a conical cavity therein, a plug having a conical side matching the configuration of the conical cavity and positioned wth the conical side in the conical cavity, a manually adjustable indexing bolt connected between said plug and said body, means for positioning said plug in respect to said cavity so as to define a mixing space therebetween in the form of a continuous conical annulus and an annular discharge opening from the mixing space in the end face, means forming a premixing chamber connected in fluid communication with the mixing space, at least two intersecting passages extending through the body for directing a liquid and gas mixture into the premixing chamber to produce a further mixing of liquid and gas and thereafter into the mixing space to produce an acceleration and still further mixing of the mixture and to discharge the mixture as a conical spray through the annular discharge opening.

3. An adjustable conical atomizer according to claims 1 or 2 including a break ring located outside of the body and facing the plug and having radially extending portions disposed adjacent the discharge for breaking up the mixture exiting from said discharge.

* * * * *